US011552387B2

(12) United States Patent
Lee et al.

(10) Patent No.: US 11,552,387 B2
(45) Date of Patent: Jan. 10, 2023

(54) ROOF ANTENNA

(71) Applicants: Hyundai Motor Company, Seoul (KR); Kia Motors Corporation, Seoul (KR); ACE TECHNOLOGIES CORPORATION, Incheon (KR)

(72) Inventors: Byoung Hyun Lee, Yongin-Si (KR); Hyunwoo Roh, Hwaseong-Si (KR); Yoon-gi Kim, Gunpo-Si (KR)

(73) Assignees: Hyundai Motor Company, Seoul (KR); Kia Motors Corporation, Seoul (KR); ACE TECHNOLOGIES CORPORATION, Incheon (KR)

( * ) Notice: Subject to any disclaimer, the term of this patent is extended or adjusted under 35 U.S.C. 154(b) by 301 days.

(21) Appl. No.: 16/664,224

(22) Filed: Oct. 25, 2019

(65) Prior Publication Data

US 2020/0185821 A1 Jun. 11, 2020

(30) Foreign Application Priority Data

Dec. 11, 2018 (KR) ..... 10-2018-0158946

(51) Int. Cl.
*H01Q 1/32* (2006.01)
*H01Q 1/42* (2006.01)
*H01Q 7/00* (2006.01)

(52) U.S. Cl.
CPC ..... *H01Q 1/3275* (2013.01); *H01Q 1/42* (2013.01); *H01Q 7/00* (2013.01)

(58) Field of Classification Search
CPC ..... H01Q 1/3275; H01Q 1/32; H01Q 1/42
See application file for complete search history.

(56) References Cited

U.S. PATENT DOCUMENTS

2013/0082158 A1* 4/2013 Sato ..... H01Q 1/1214 248/534
2013/0169489 A1* 7/2013 Tamura ..... H01Q 1/1214 343/702
2014/0125550 A1* 5/2014 Kaneko ..... H01Q 1/24 343/872
2017/0317407 A1* 11/2017 Yasin ..... H01Q 1/42

FOREIGN PATENT DOCUMENTS

EP 3561952 A1 * 10/2019 ..... H01Q 1/3275
KR 10-1342027 B1 12/2013
KR 10-1798523 B1 12/2017

* cited by examiner

*Primary Examiner* — Ricardo I Magallanes
(74) *Attorney, Agent, or Firm* — Morgan, Lewis & Bockius LLP

(57) ABSTRACT

A roof antenna may include an upper case formed to be opened at a lower portion thereof and including a plurality of fusion bosses and a plurality of hooks at the lower portion, a lower case coupled to the plurality of fusion bosses and the plurality of hooks to shield the opened lower portion of the upper case and configured to be coupled to a roof of a vehicle, and a rubber pad mounted to a lower portion of the lower case to prevent exposure to the outside by the upper case and provided so that the lower case is configured to be water-tightly coupled to the roof of the vehicle.

18 Claims, 14 Drawing Sheets

ROOF ANTENNA

CROSS-REFERENCE TO RELATED APPLICATION(S)

The present application claims priority to Korean Patent Application No. 10-2018-0158946, filed on Dec. 11, 2018, the entire contents of which is incorporated herein for all purposes by this reference.

BACKGROUND OF THE INVENTION

Field of the Invention

The present invention relates to a roof antenna attached to a vehicle.

Description of Related Art

Generally, an antenna for receiving or transmitting radio waves is provided outside a vehicle.

The antenna is disposed outside the vehicle to receive or transmit radio waves. A hole is formed on a portion of a roof for mounting the antenna outside the vehicle, and the antenna is disposed on the roof to be externally exposed through the hole.

For the antenna to receive or transmit radio waves, there may be no metallic material in the directions in which the radio waves are received or transmitted, and thus the hole is formed in the roof so that the antenna may be disposed to be exposed to the outside.

Generally, the antenna includes an upper case having an opened lower portion and a lower case and a lower case having a circuit board therein and coupled to the upper case by screws, and the lower case may be coupled to the roof of the vehicle.

To couple the upper case and the lower case with screws, the upper case made of plastic is provided with threaded boss holes. In a process of forming threads in the boss holes and after the threads are formed in the boss holes, stress and plastic deformation may occur in the boss of the upper case and the strength may be lowered, and the boss of the upper case may be cracked or broken by a long-term external environmental influence due to the characteristics of the vehicle.

Furthermore, a head portion of the screw externally exposed may repeatedly come into contact with water when the vehicle is used for a long time period, so that the coating for preventing corrosion may be oxidized, causing rust or corrosion.

Furthermore, to prevent water or moisture from penetrating into the inside of the vehicle through the roof of the vehicle provided with the antenna, a black rubber pad different from the colors of the vehicle and antenna is disposed between the roof and the antenna to be exposed to the outside, deteriorating the appearance quality.

The information included in Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a roof antenna to which ultrasonic and thermal fusion techniques in a process of coupling an upper case and a lower case are applied to replace a screw fastening structure.

Various aspects of the present invention are directed to providing a roof antenna in which a rubber pad disposed between a roof of a vehicle and the roof antenna is not exposed to the outside.

Additional various aspects of the present invention will be set forth in part in the description which follows and, in part, will be obvious from the description, or may be learned by practice of the present invention.

In accordance with an aspect of the present invention, a roof antenna may include an upper case formed to be opened at a lower portion thereof and including a plurality of fusion bosses and a plurality of hooks at the lower portion, a lower case coupled to the plurality of fusion bosses and the plurality of hooks to shield the opened lower portion of the upper case and configured to be coupled to a roof of a vehicle, and a rubber pad mounted to a lower portion of the lower case to prevent exposure to the outside by the upper case and provided so that the lower case is configured to be water-tightly coupled to the roof of the vehicle.

The upper case may be provided to have a streamlined dome shape, and the plurality of fusion bosses may include a first fusion boss and a second fusion boss provided in a front and a rear of the upper case, respectively.

The lower case may include a plurality of fusion holes into which the plurality of fusion bosses is inserted and a plurality of hook coupling portions to which the plurality of hooks is coupled.

The plurality of fusion holes may include a first fusion hole into which the first fusion boss is inserted and a second fusion hole into which the second fusion boss is inserted.

The first fusion boss and the second fusion boss may each include a cross-shaped protrusion to determine a position where the upper case and the lower case are to be coupled.

The first fusion hole and the second fusion hole may each include a cross-shaped groove into which the cross-shaped protrusion is inserted.

The first fusion hole and the second fusion hole may each include a first fixing groove and a second fixing groove each having a diameter greater than diameters of the first fusion hole and the second fusion hole so that the first fusion boss and the second fusion boss inserted into the first fusion hole and the second fusion hole may be fused and fixed.

A circuit board may be mounted on an upper portion of the lower case, and the upper case may include a first watertight partition provided such that the upper case and the lower case may be water-tightly coupled to each other to block the inflow of moisture into the circuit board.

The lower case may include a first watertight groove to receive the first watertight partition.

The lower case may include a roof coupling portion provided at the lower portion of the lower case to be coupled to the roof of the vehicle.

The lower case may include a spacing member provided to be spaced from the rubber pad to form an air layer between the lower case and the rubber pad mounted to the lower portion of the lower case.

The spacing member may include a first spacing portion formed along a lower circumference of the lower case and a second spacing portion formed between the first spacing portion and the roof coupling portion.

The rubber pad may include a protrusion rib formed to protrude from a rim portion of the rubber pad toward the lower case, fitting grooves provided at the protrusion rib to allow a rim portion of the lower case to be fitted and assembled, and split grooves provided at the protrusion rib to prevent interference with the plurality of hooks.

The rubber pad may include a through hole provided to allow the roof coupling portion to be coupled to the roof of the vehicle.

The roof of the vehicle may include an antenna mounting hole provided to allow the roof coupling portion that passes through the through hole to be coupled to the roof of the vehicle.

The rubber pad may include a plurality of second watertight partitions formed to protrude from a rim portion thereof toward the roof of the vehicle to block the inflow of moisture into the antenna mounting hole.

In accordance with another aspect of the present invention, a roof antenna may include an upper case provided to have a streamlined dome shape and opened at a lower portion, a lower case coupled to the lower portion of the upper case to shield the opened lower portion of the upper case and configured to be coupled to a roof of a vehicle, and a rubber pad mounted to a lower portion of the lower case and including a plurality of watertight partitions provided so that the lower case is configured to be water-tightly coupled to the roof of the vehicle, wherein the watertight partition positioned at an outermost side among the plurality of watertight partitions is positioned inside the upper case to be prevented from being exposed to the outside.

The upper case may include a plurality of fusion bosses and a plurality of hooks, and the lower case may include a plurality of fusion holes into which the plurality of fusion bosses is inserted and fused and a plurality of hook coupling portions to which the plurality of hooks is coupled.

The plurality of fusion bosses may include a cross-shaped protrusion to determine a position where the upper case and the lower case are to be coupled, and the plurality of fusion holes may include a cross-shaped groove into which the cross-shaped protrusion is inserted.

The rubber pad may include a protrusion rib formed to protrude from a rim portion of the rubber pad toward the lower case, fitting grooves provided at the protrusion rib to allow a rim portion of the lower case to be fitted and assembled, and split grooves provided at the protrusion rib to prevent interference with the plurality of hooks.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
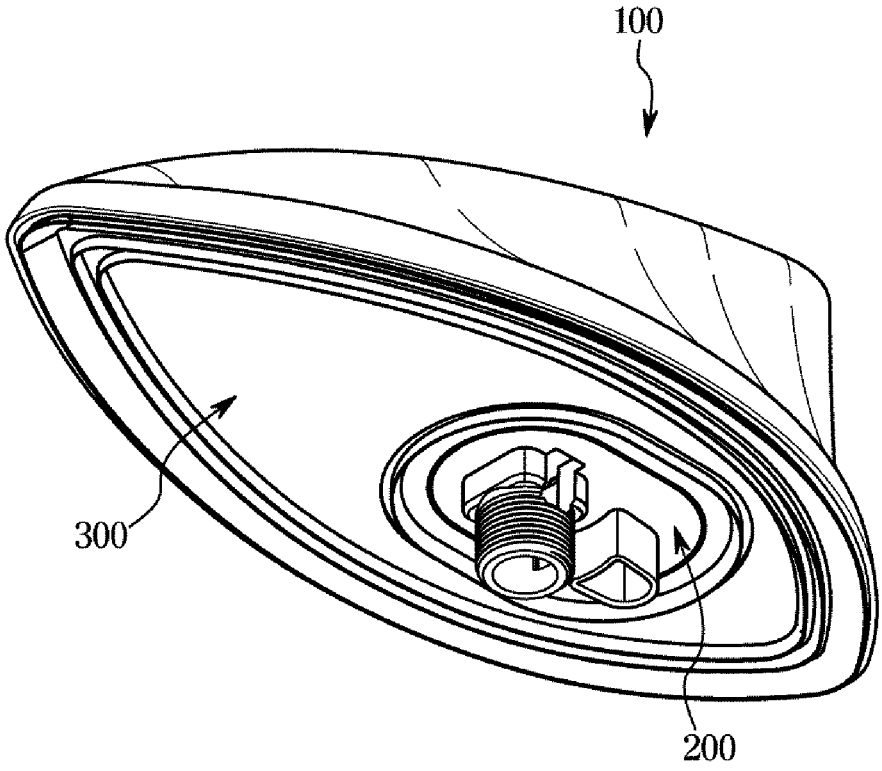
FIG. 1 is a perspective view of a roof antenna according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

The exemplary embodiments described herein and the configurations shown in the drawings are only examples of exemplary embodiments of the present invention, and various modifications may be made at the time of filing of the present invention to replace the exemplary embodiments and drawings of the exemplary embodiment of the present invention.

Like reference numbers or designations in the various figures of the present invention represent parts or components that perform substantially the same functions.

The terms used herein are for the purpose of describing the exemplary embodiments and are not intended to restrict and/or to limit the present invention. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms "first," "second," etc. may be used herein to describe various components, these components should not be limited by these terms. These terms are only used to distinguish one component from another. For example, without departing from the scope of the present invention, the first component may be referred to as a second component, and similarly, the second component may also be referred to as a first component. The term "and/or" includes any combination of a plurality of related items or any one of a plurality of related items.

In the exemplary embodiment, the terms "front," "rear," "upper," "lower," "left," and "right" are defined with reference to the drawings, and the shape and position of each component are not limited by these terms.

Hereinafter, according to an exemplary embodiment of the present invention will be described in detail with reference to the accompanying drawings.

Figure 2:
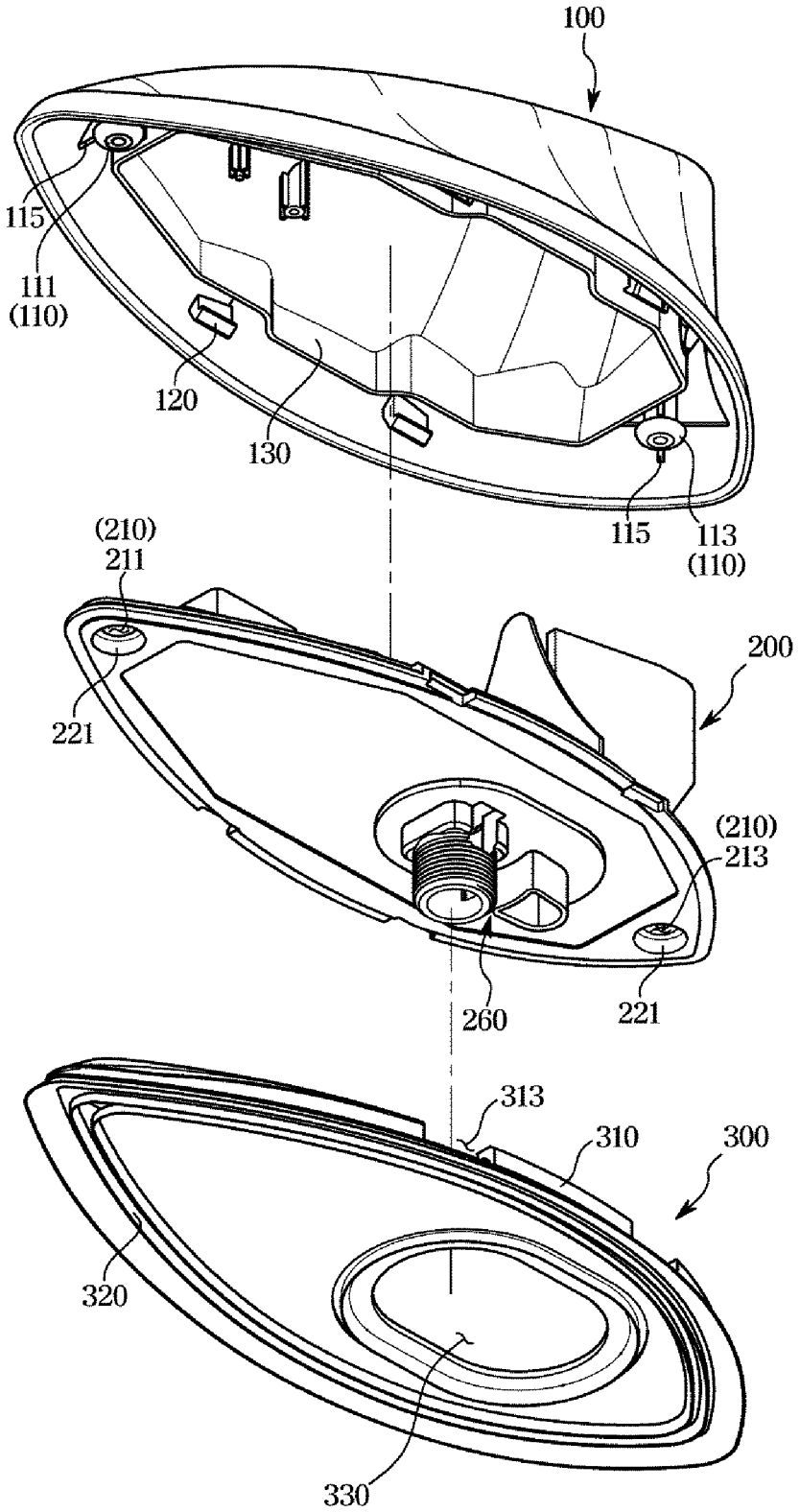
FIG. 2 is an exploded perspective view of the roof antenna according to an exemplary embodiment of the present invention.
Figure 3:
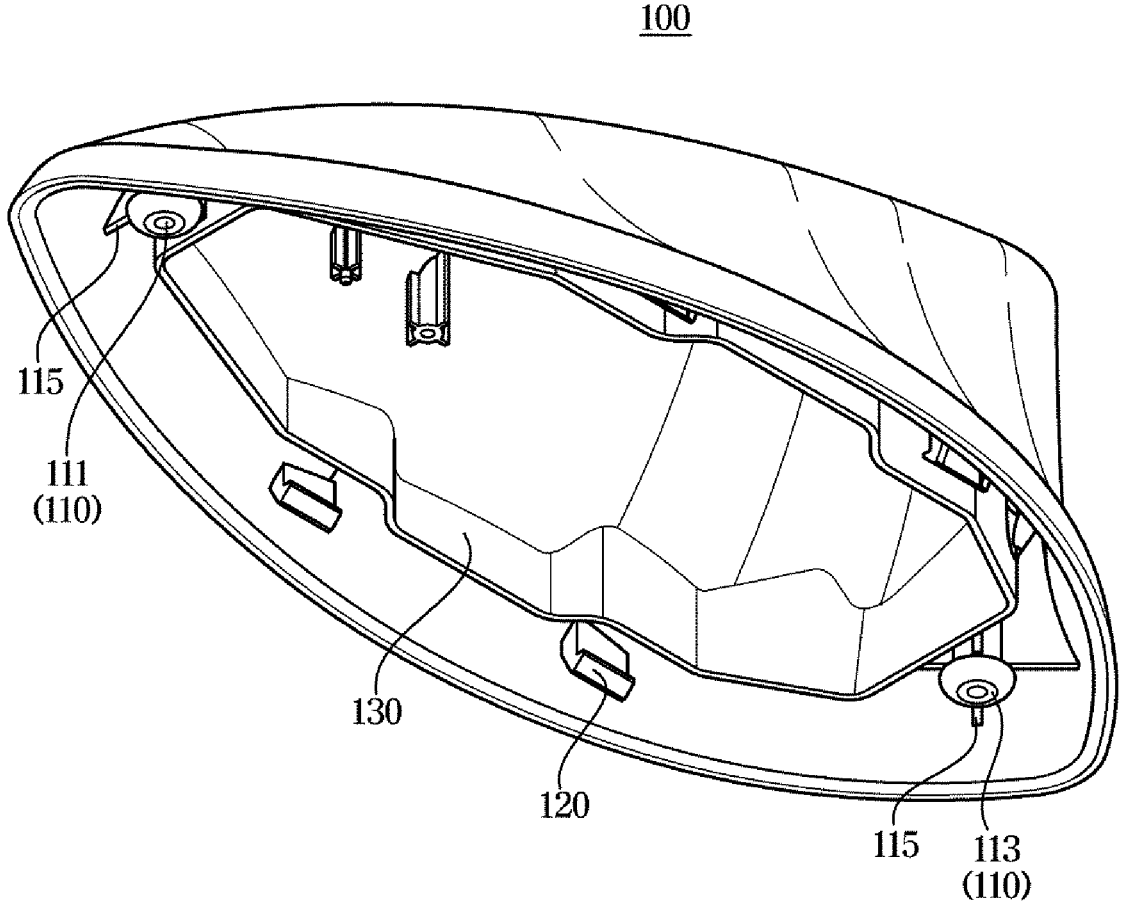
FIG. 3 is a perspective view of an upper case according to an exemplary embodiment of the present invention.
Figure 4:
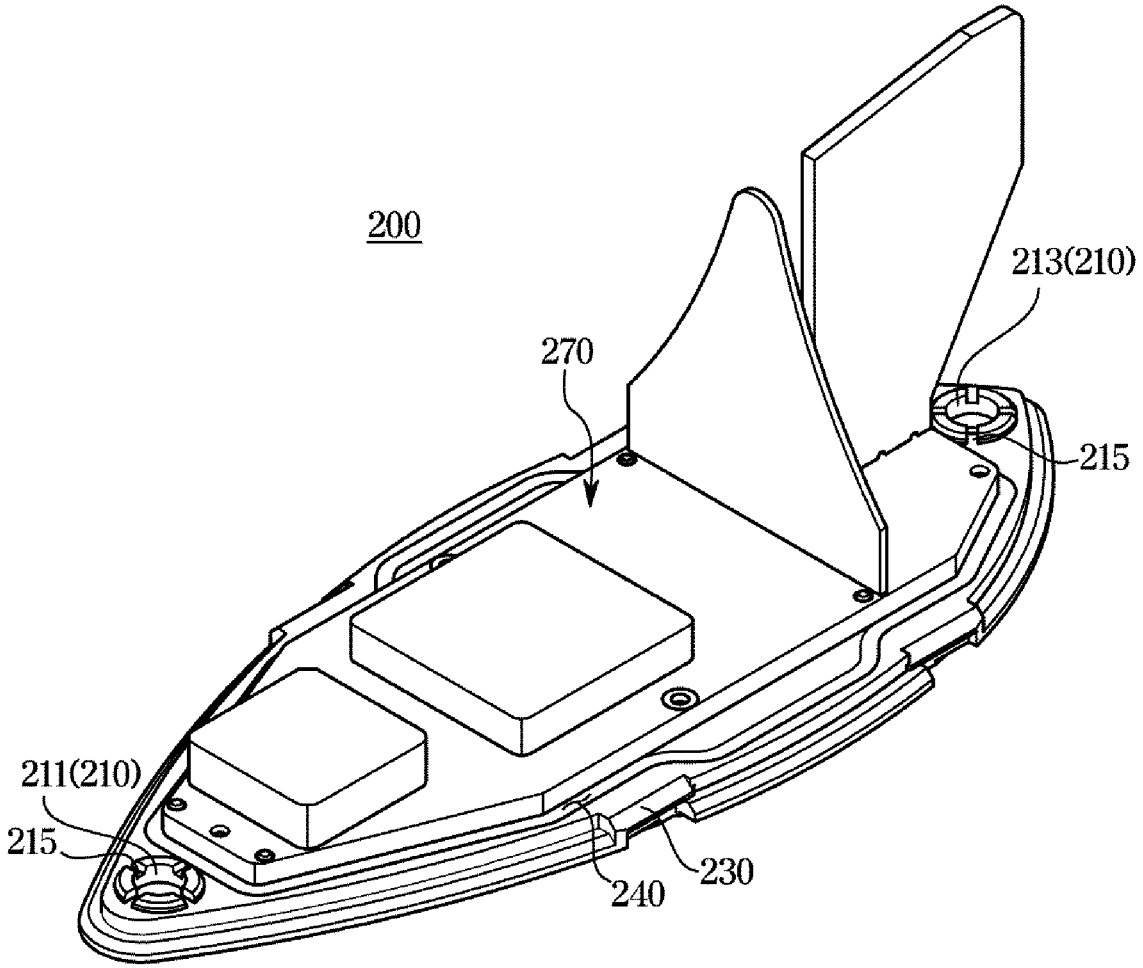
FIG. 4 is an upper perspective view of a lower case according to an exemplary embodiment of the present invention.
Figure 5:
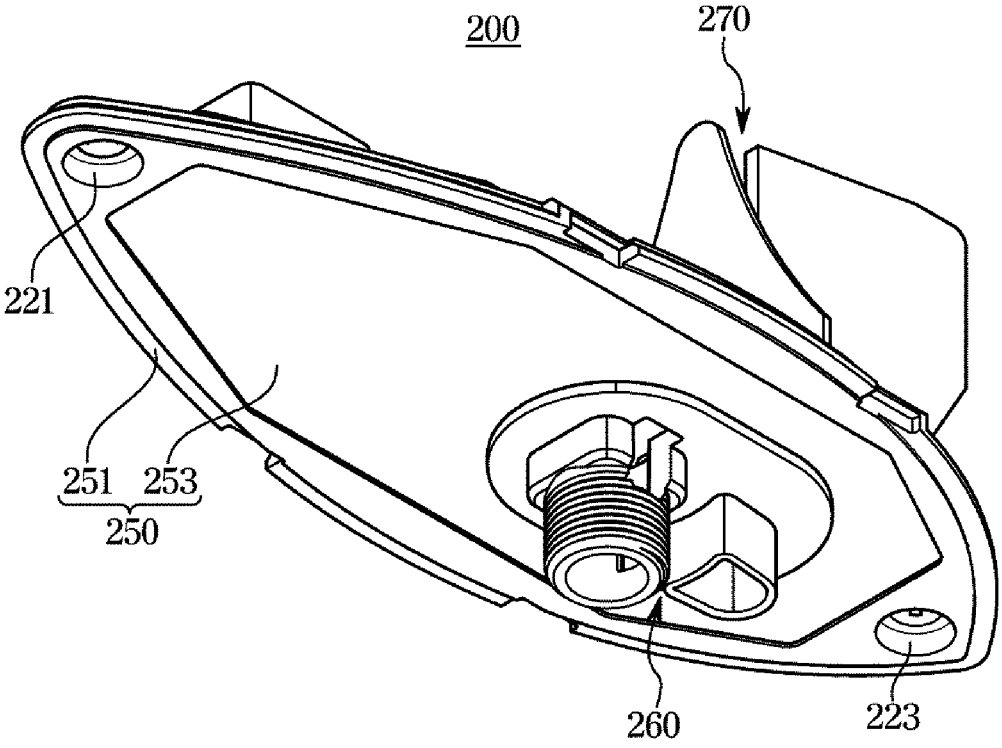
FIG. 5 is a lower perspective view of the lower case according to an exemplary embodiment of the present invention.
Figure 6:
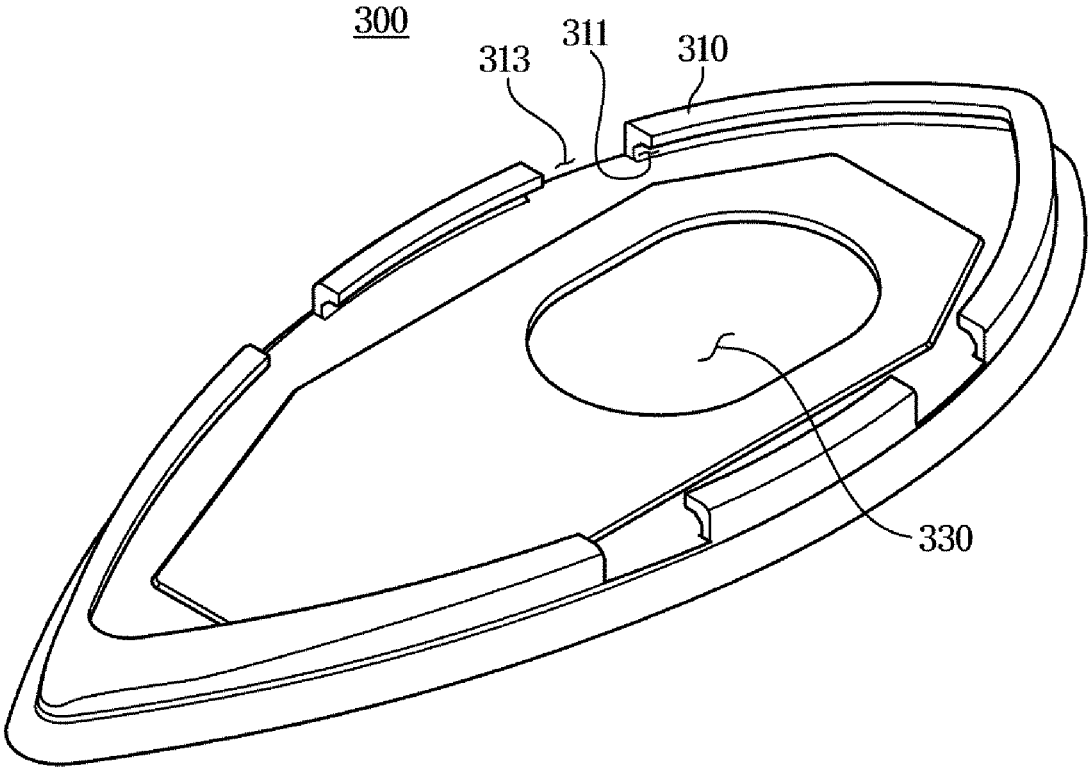
FIG. 6 is an upper perspective view of a rubber pad according to an exemplary embodiment of the present invention.
Figure 7:
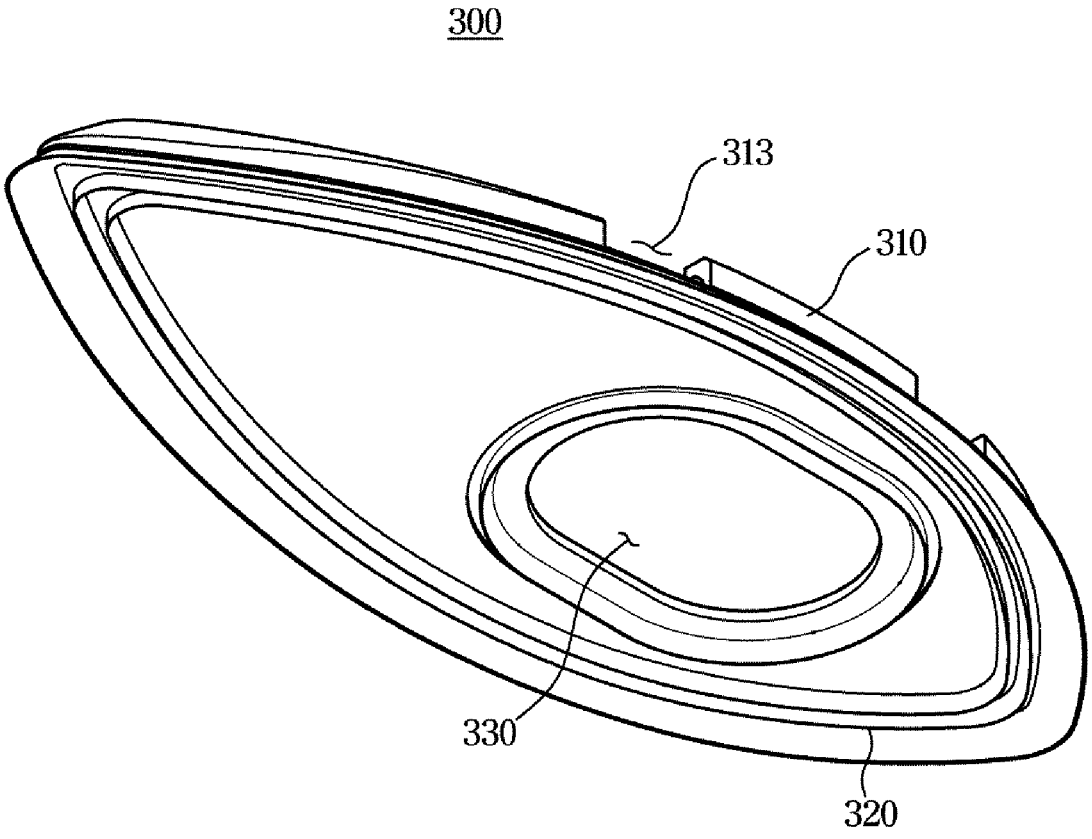
FIG. 7 is a lower perspective view of the rubber pad according to an exemplary embodiment of the present invention.

FIG. 1 is a perspective view of a roof antenna according to an exemplary embodiment of the present invention, FIG. 2 is an exploded perspective view of the roof antenna according to an exemplary embodiment of the present invention, FIG. 3 is a perspective view of an upper case according to an exemplary embodiment of the present invention, FIG. 4 is an upper perspective view of a lower case according to an exemplary embodiment of the present invention, FIG. 5 is a lower perspective view of the lower case according to an exemplary embodiment of the present invention, FIG. 6 is an upper perspective view of a rubber pad according to an exemplary embodiment of the present invention, and FIG. 7 is a lower perspective view of the rubber pad according to an exemplary embodiment of the present invention.

Figure 11:
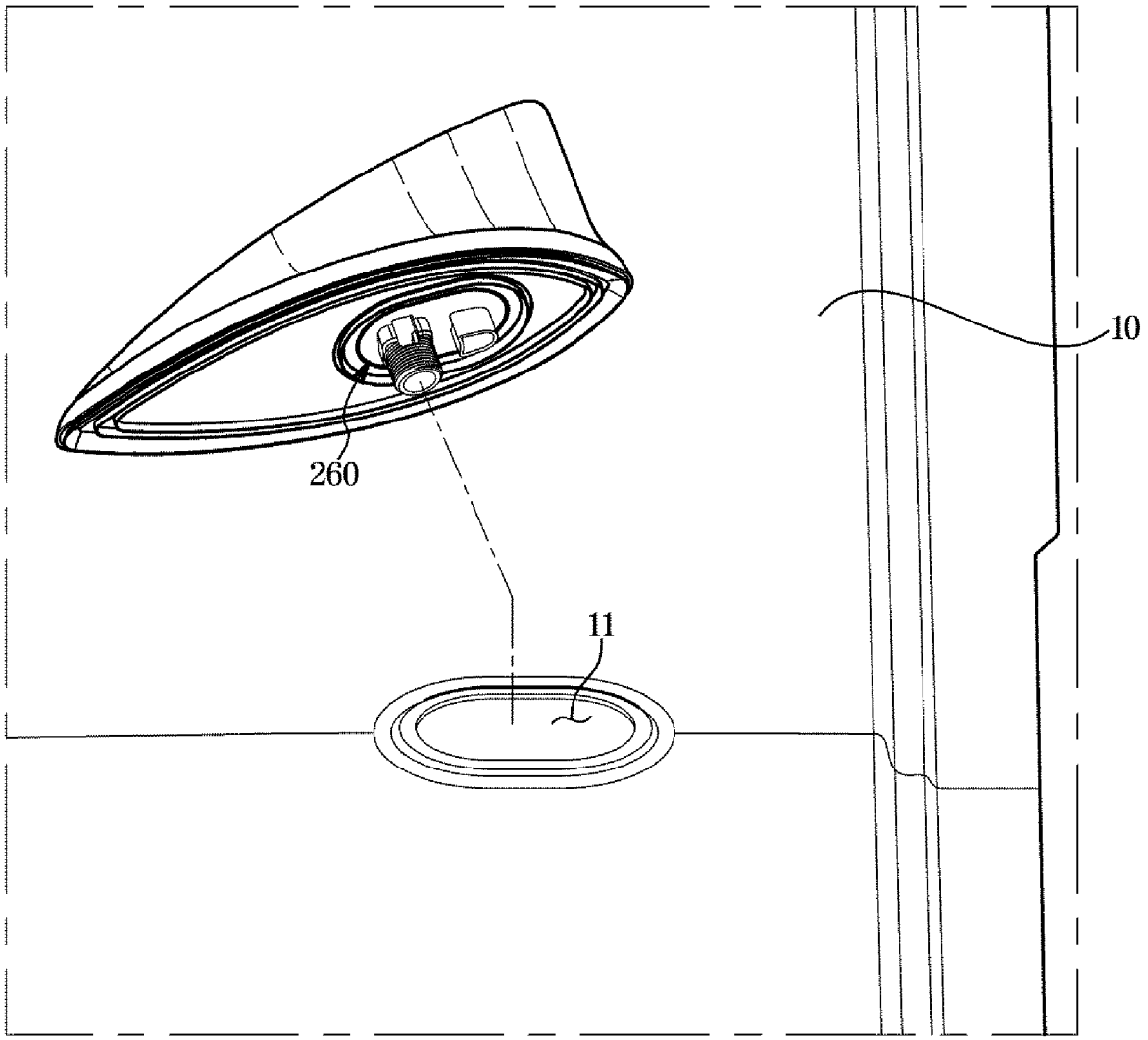
FIG. 11 is a view exemplarily illustrating that a roof coupling portion of the roof antenna according to an exemplary embodiment of the present invention is inserted into an antenna mounting hole of a roof.

As illustrated in FIG. 1 and FIG. 2, the roof antenna may include an upper case 100 formed in a streamlined dome shape and opened at a lower portion thereof, a lower case 200 coupled to a lower portion of the upper case 100 to shield the opened lower portion of the upper case 100, and a rubber pad 300 mounted to a lower portion of the lower case 200 coupled to a roof 10 of a vehicle so that the lower case 200 is water-tightly coupled to the roof 10 (refer to FIG. 11).

As illustrated in FIG. 3, the upper case 100 may be provided to have a streamlined dome shape to minimize air resistance while driving of the vehicle.

The upper case 100 may be made of a plastic polymer material such as PC (polycarbonate) or PC+ABS (acrylonitrile butadiene styrene).

The upper case 100 may include a plurality of fusion bosses 110 and a plurality of hooks 120 for coupling the upper case 100 and the lower case 200.

The plurality of fusion bosses 110 may include a first fusion boss 111 provided in the front of the upper case 100 and a second fusion boss 113 provided in the rear of the uppercase 100.

The first fusion boss 111 and the second fusion boss 113 may be inserted into a first fusion hole 211 and a second fusion hole 213 of the lower case 200, which will be described later, and then may be coupled to the first fusion hole 211 and the second fusion hole 213 by a thermal or ultrasonic fusion process (refer to FIG. 9).

The first fusion boss 111 and the second fusion boss 113 each may include a cross-shaped protrusion 115 for determining a position where the upper case 100 and the lower case 200 are coupled.

The cross-shaped protrusions 115 may be provided on external circumferential surfaces of the first fusion boss 111 and the second fusion boss 113, respectively, to extend in a radial direction of the first fusion boss 111 and the second fusion boss 113.

Each of the cross-shaped protrusions 115 may be inserted into each of cross-shaped grooves 215 of the lower case 200, which will be described later, to determine a precise coupling position between the upper case 100 and the lower case 200

Each of the plurality of hooks 120 may be coupled to each of a plurality of hook coupling portions of the lower case 200, which will be described later (refer to FIG. 8).

The upper case 100 may include a first watertight partition 130 to allow the upper case 100 and lower case 200 to be water-tightly coupled to each other.

The first watertight partition 130 is provided in a rib shape to be accommodated in a first watertight groove 240 of the lower case 200, which will be described later, and may prevent the infiltration of moisture into a circuit board 270 mounted on an upper surface of the lower case 200 by allowing the coupled upper case 100 and lower case 200 to be water-tightly coupled to each other (refer to FIG. 4).

As illustrated in FIG. 4 and FIG. 5, the circuit board 270 may be mounted on the upper surface of the lower case 200.

The lower case 200 may be made of a metal material such as aluminum or zinc to maintain rigidity of the roof antenna and to ground and energize the roof antenna.

The lower case 200 may include a plurality of fusion holes 210 in which the plurality of fusion bosses 110 is inserted and fused and a plurality of hook coupling portions 230 to which the plurality of hooks 120 is coupled.

The plurality of fusion holes 210 may include the first fusion hole 211 into which the first fusion boss 111 is inserted and the second fusion hole 213 into which the second fusion boss 113 is inserted.

The first fusion hole 211 and the second fusion hole 213 each may include the cross-shaped groove 215 into which the cross-shaped protrusion 115 is inserted.

The first fusion hole 211 and the second fusion hole 213 may include a first fixing groove 221 and a second fixing groove 223, respectively, to fuse and fix the first fusion boss 111 and the second fusion boss 113, which are inserted into the first fusion hole 211 and the second fusion hole 213, by heat or ultrasonic waves.

The first fixing groove 221 and the second fixing groove 223 may be provided at lower portions of the first fusion hole 211 and the second fusion hole 213, respectively.

Figure 9:
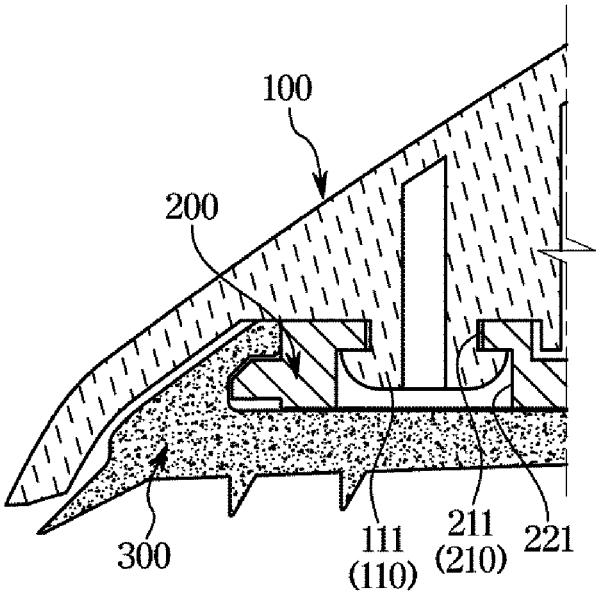
FIG. 9 is a view exemplarily illustrating a state in which a fusion boss of the upper case according to an exemplary embodiment of the present invention is inserted and fused in a fusion hole of the lower case.

The first fixing groove 221 and the second fixing groove 223 may be provided to have a diameter greater than those of the first fusion hole 211 and the second fusion hole 213 so that the first fusion boss 111 and the second fusion boss 113 are fused and fixed (refer to FIG. 9).

The lower case 200 may include the first watertight groove 240 provided on the upper surface thereof to receive the first watertight partition 130 of the upper case 100 to allow the upper case 100 and lower case 200 to be water-tightly coupled to each other.

Figure 12:
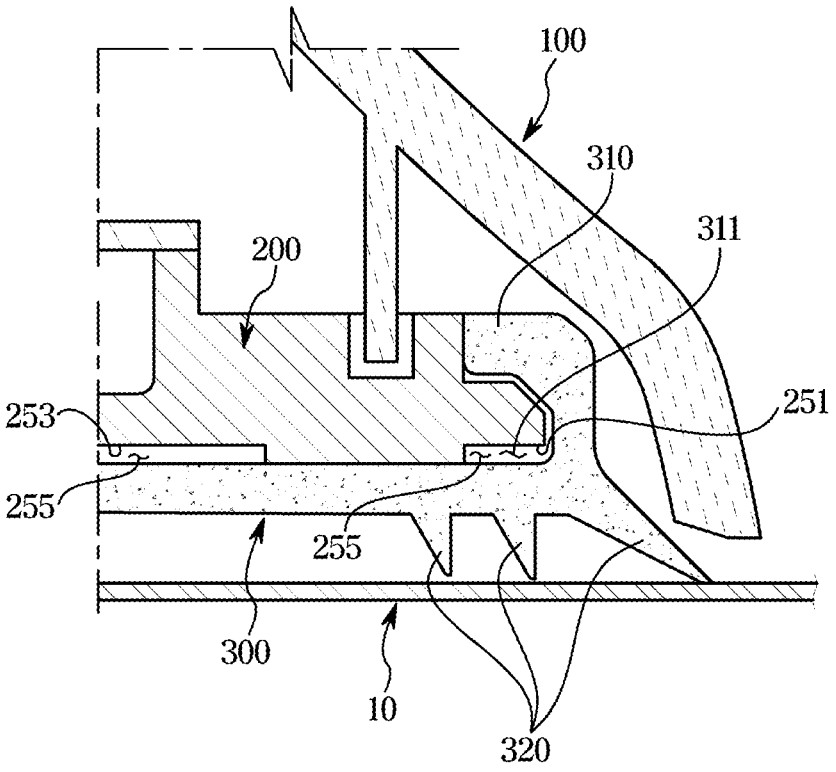
FIG. 12 is a cross-sectional view exemplarily illustrating a portion of the roof and a portion of the roof antenna when the roof coupling portion of the roof antenna according to an exemplary embodiment of the present invention is inserted into the antenna mounting hole of the roof.

The lower case 200 may include a spacing member 250 provided to be spaced from the rubber pad 300 to form an air layer 255 between the lower case 200 and the rubber pad 300 mounted to the lower portion of the lower case 200 (refer to FIG. 12).

The spacing member 250 may include a first spacing portion 251 formed along a lower circumference of the lower case 200 and a second spacing portion 253 formed between the first spacing portion 251 and a roof coupling portion 260, which will be described later.

The first spacing portion 251 and the second spacing portion 253 are provided at a lower surface of the lower case 200 and may be provided in a depressed shape upwards from the lower surface of the lower case 200.

Accordingly, the lower surface of the lower case 200 is in contact with an upper surface of the rubber pad 300, and the first spacing portion 251 and the second spacing portion 253 are spaced from the upper surface of the rubber pad 300, so that the air layer 255 may be formed between the lower surface of the lower case 200 and the upper surface of the rubber pad 300.

The first spacing portion 251 and the second spacing portion 253 allow the air layer 255 to be formed between the lower case 200 and the rubber pad 300, so that the compression force may be reduced after the lower case 200 and the rubber pad 300 are coupled to each other, increasing the close contact with the roof 10 of the vehicle and reducing deformation of the roof 10 (refer to FIG. 12).

Figure 14:
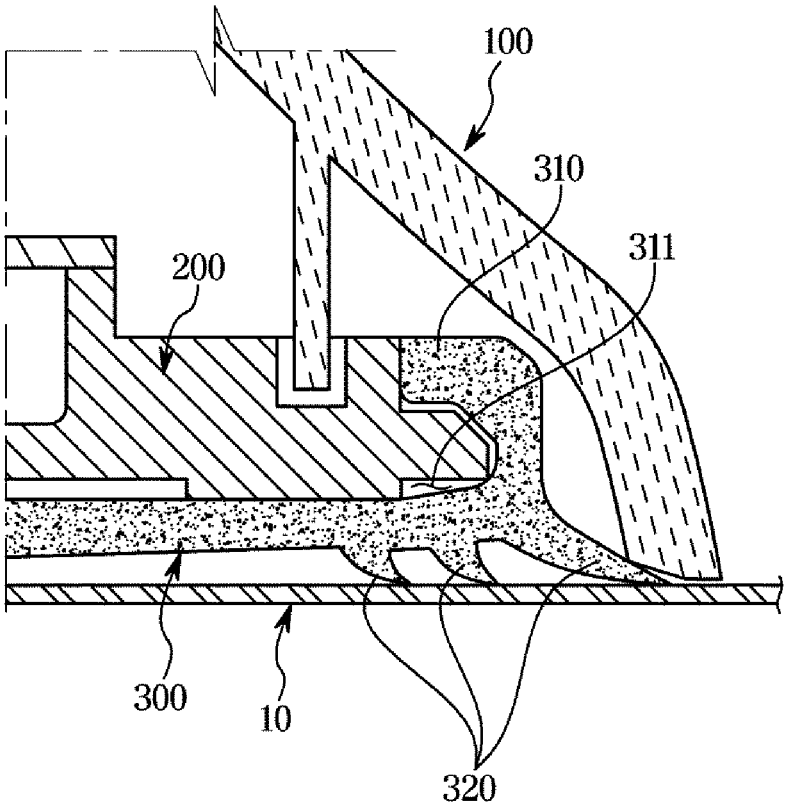
FIG. 14 is a cross-sectional view exemplarily illustrating a portion of the roof and a portion of the roof antenna when the nut is fastened to the roof coupling portion according to an exemplary embodiment of the present invention.

The lower case 200 may include the roof coupling portion 260 provided at the lower portion of the lower case 200 and coupled to the roof 10 of the vehicle (refer to FIG. 14).

The roof 10 of the vehicle may include an antenna mounting hole 11 to which the roof coupling portion 260 is coupled so that the lower case 200 may be coupled to the roof 10 of the vehicle (refer to FIG. 14).

As illustrated in FIG. 6 and FIG. 7, the rubber pad 300 may include a protrusion rib 310 formed to protrude upwards from a rim portion of the upper surface of the rubber pad 300 and a plurality of second watertight partitions 320 formed to protrude downwardly from a rim portion of a lower surface of the rubber pad 300.

The rubber pad 300 may be made of soft powder rubber having a hardness of 50 to 70 degrees such as EPDM (Ethylene Propylene Diene Monomer) and TPE (Thermo Plastic Elastomer).

The rubber pad 300 is mounted to the lower portion of the lower case 200 to allow the lower case 200 to be water-tightly coupled to the roof 10 of the vehicle (refer to FIG. 14).

Because the protruding rib 310 protrudes upwards from the rim portion of the upper surface of the rubber pad 300, the rubber pad 300 may protrude toward the lower case 200 to which the rubber pad 300 is assembled (refer to FIG. 2).

The protruding rib 310 may include fitting grooves 311 in which the rim portion of the lower case 200 is fitted and assembled, and split grooves 313 provided to prevent interference with the plurality of hooks 120 and a plurality of hook coupling portions 230.

The fitting grooves 311 may be formed on a lower portion of the protruding rib 310 in a depressed shape in the direction toward the outside from a center portion of the rubber pad 300.

The split grooves 313 are provided to have a number corresponding to the number of the hooks 120 and the hook coupling portions 130 and may be formed in a depressed shape in the downward direction from the protruding rib 310.

Therefore, the split grooves 313 may prevent the protruding rib 310 from interfering with the plurality of hooks 120 and the plurality of hook coupling portions 130.

The plurality of second watertight partitions 320 may be provided in a rib shape protruding downward at a rim portion of the lower surface of the rubber pad 300.

When the lower case 200 to which the rubber pad 300 is mounted is coupled to the roof 10 of the vehicle, the plurality of second watertight partitions 320 may be brought into close contact with the roof 10 of the vehicle to allow the lower case 200 to be water-tightly coupled to the roof 10 of the vehicle.

When the lower case 200 is water-tightly coupled to the roof 10 of the vehicle, the inflow of moisture into the antenna mounting hole 11 of the roof 10 may be blocked.

Therefore, moisture may be prevented from penetrating into the inside of the vehicle through the antenna mounting hole 11 of the roof 10.

The rubber pad 300 may include a through hole 330 provided to allow the roof coupling portion 260 of the lower case 200 to be coupled to the roof 10 of the vehicle.

Figure 8:
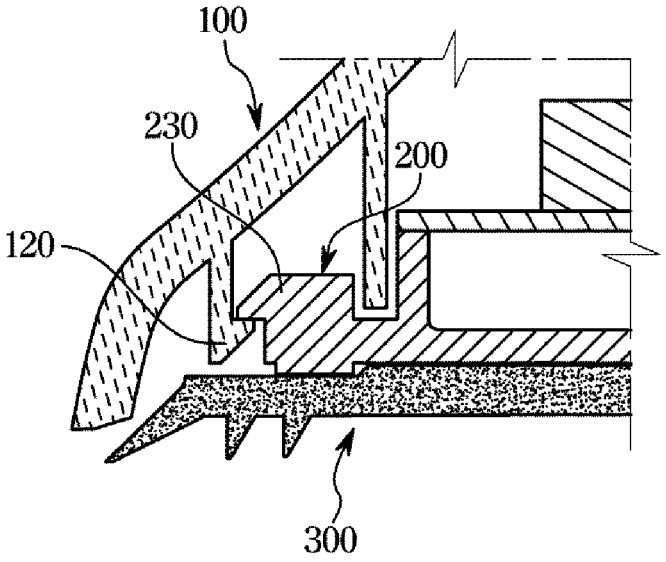
FIG. 8 is a view exemplarily illustrating a state in which a hook of the upper case according to an exemplary embodiment of the present invention is coupled to a hook coupling portion of the lower case.
Figure 10:
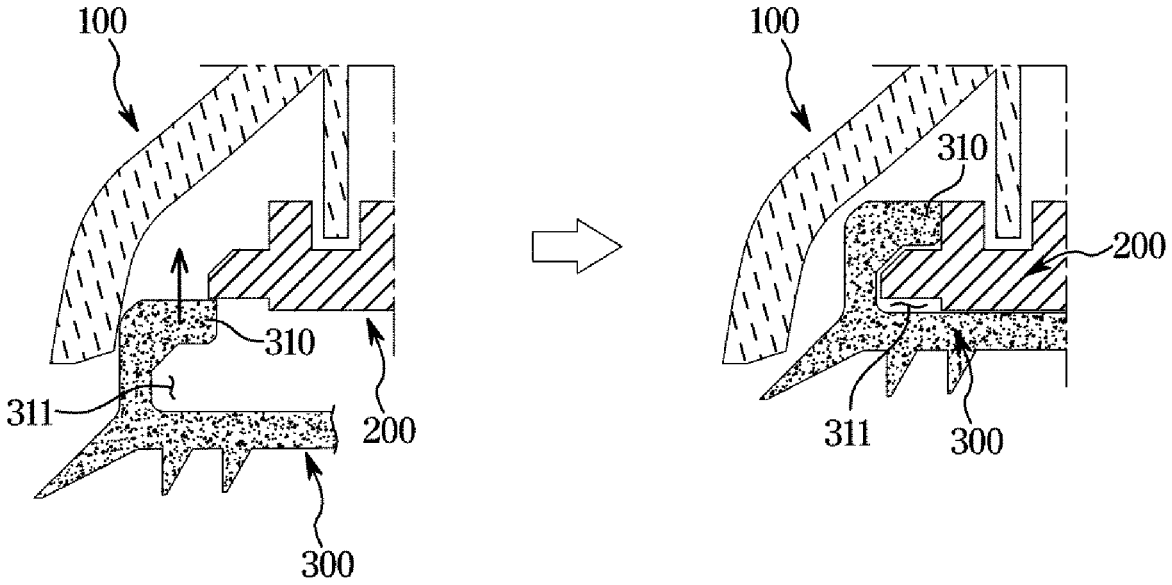
FIG. 10 is a view exemplarily illustrating a process of assembling the lower case and the rubber pad according to an exemplary embodiment of the present invention.

FIG. 8 is a view exemplarily illustrating a state in which a hook of the upper case according to an exemplary embodiment of the present invention is coupled to a hook coupling portion of the lower case, FIG. 9 is a view exemplarily illustrating a state in which a fusion boss of the upper case according to an exemplary embodiment of the present invention is inserted and fused in a fusion hole of the lower case, and FIG. 10 is a view exemplarily illustrating a process of assembling the lower case and the rubber pad according to an exemplary embodiment of the present invention.

When the cross-shaped protrusions 115 of the upper case 100 are inserted into the cross-shaped grooves 215 of the lower case 200, the coupling position of the upper case 100 and the lower case 200 is determined.

At the present time, the plurality of fusion bosses 110 is inserted into the plurality of fusion holes 210.

In a state where the coupling position of the upper case 100 and the lower case 200 is determined, each of the hooks 120 of the upper case 100 is coupled to each of the hook coupling portions 230 of the lower case 200, as illustrated in FIG. 8.

After each of the hooks 120 of the upper case 100 is coupled to each of the hook coupling portions 230 of the lower case 200, each of the fusion bosses 110 is fused by heat or ultrasonic waves, as illustrated in FIG. 9.

When the fusion bosses 110 are fused, the end portions of the fusion bosses 110 are fixed to the first fixing groove 221 and the second fixing groove 223 so that the upper case 100 and the lower case 200 are coupled.

When the upper case 100 and the lower case 200 are coupled, the lower case 200 and the rubber pad 300 are assembled, as illustrated in FIG. 10.

The lower case 200 and the rubber pad 300 are assembled by inserting the rim portion of the lower case 200 into the fitting grooves 311 of the rubber pad 300.

Figure 13:
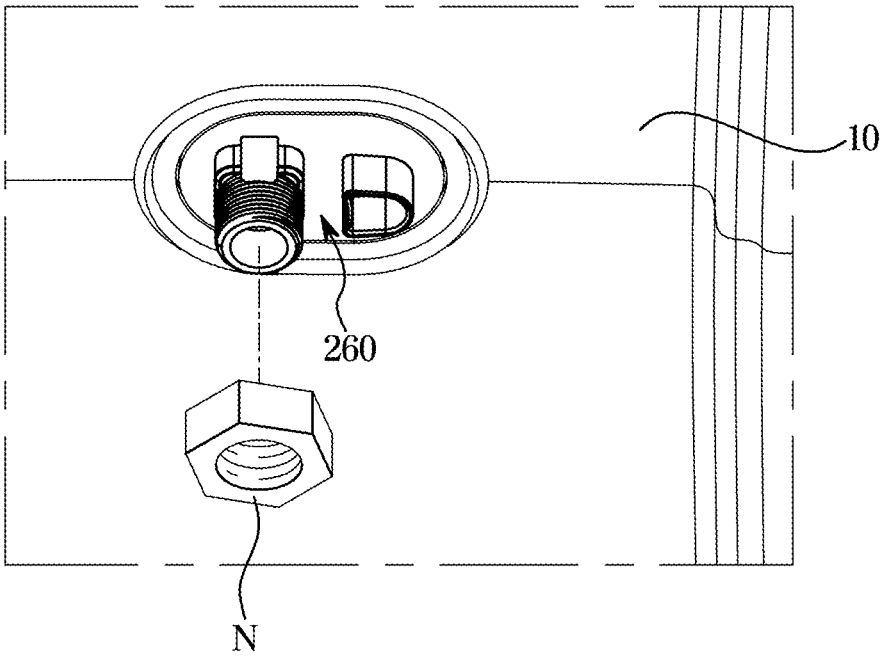
FIG. 13 is a view exemplarily illustrating that a nut is fastened to the roof coupling portion according to an exemplary embodiment of the present invention.

FIG. 11 is a view exemplarily illustrating that a roof coupling portion of the roof antenna according to an exemplary embodiment of the present invention is inserted into an antenna mounting hole of a roof, FIG. 12 is a cross-sectional view exemplarily illustrating a portion of the roof and a portion of the roof antenna when the roof coupling portion of the roof antenna according to an exemplary embodiment of the present invention is inserted into the antenna mounting hole of the roof, FIG. 13 is a view exemplarily illustrating that a nut is fastened to the roof coupling portion according to an exemplary embodiment of the present invention, and FIG. 14 is a cross-sectional view exemplarily illustrating a portion of the roof and a portion of the roof antenna when the nut is fastened to the roof coupling portion according to an exemplary embodiment of the present invention.

As illustrated in FIG. 11, the roof coupling portion 260 of the roof antenna is inserted into the antenna mounting hole 11 of the roof 10 to couple the roof antenna to the roof 10 of the vehicle.

When the roof coupling portion 260 is inserted into the antenna mounting hole 11 of the roof 10, the plurality of second watertight partitions 320 of the rubber pad 300 is brought into contact with the roof 10, as illustrated in FIG. 11.

When the roof coupling portion 260 is completely inserted into the antenna mounting hole 11 of the roof 10 so that the plurality of second watertight partitions 320 of the rubber pad 300 is in contact with the roof 10, a nut N is fastened to the roof coupling portion 260 inserted into the antenna mounting hole 11 of the roof 10, as illustrated in FIG. 13.

When the roof antenna is completely coupled to the roof 10 by fastening the nut N to the roof coupling portion 260, the end portion of the second watertight partition 320, which is positioned at an outermost side among the plurality of second watertight partitions 320 of the rubber pad 300, is positioned inside the upper case 100 which is in close contact with the roof 10, as illustrated in FIG. 14.

Therefore, the rubber pad 300 may be prevented from being externally exposed by the upper case 100 in a state where the roof antenna is coupled to the roof 10 of the vehicle.

As is apparent from the above, according to an exemplary embodiment of the present invention, the durability and weather resistance of a roof antenna may be improved.

Furthermore, by preventing exposure of a rubber pad, the feeling of unity with a roof of a vehicle may be improved and the appearance of the vehicle may be improved.

Furthermore, the compression load of the rubber pad may be reduced to minimize the flexural deformation of the roof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A roof antenna apparatus comprising:

an upper case formed to be opened at a lower portion thereof and including a plurality of fusion bosses and a plurality of hooks at the lower portion;

a lower case coupled to the plurality of fusion bosses and the plurality of hooks to shield the opened lower portion of the upper case and configured to be coupled to a roof of a vehicle; and a rubber pad mounted to a lower portion of the lower case to prevent exposure to an outside thereof by the upper case and provided so that the lower case is configured to be water-tightly coupled to the roof of the vehicle, wherein the lower case includes a plurality of fusion holes into which the plurality of fusion bosses is inserted and a plurality of hook coupling portions to which the plurality of hooks is coupled, wherein the plurality of fusion bosses inserted into the plurality of fusion holes are fused and fixed thereto, and wherein the lower case includes a spacing member provided to be spaced from the rubber pad to form an air layer between the lower case and the rubber pad mounted to the lower portion of the lower case.

2. The roof antenna apparatus according to claim 1, wherein the upper case is provided to have a streamlined dome shape, and the plurality of fusion bosses includes a first fusion boss and a second fusion boss provided in a front and a rear of the upper case, respectively.

3. The roof antenna apparatus according to claim 2, wherein the plurality of fusion holes includes a first fusion hole into which the first fusion boss is inserted and a second fusion hole into which the second fusion boss is inserted.

4. The roof antenna apparatus according to claim 3, wherein each of the first fusion boss and the second fusion boss includes a cross-shaped protrusion to determine a position where the upper case and the lower case are to be coupled.

5. The roof antenna apparatus according to claim 4, wherein each of the first fusion hole and the second fusion hole includes a cross-shaped groove into which the cross-shaped protrusion is inserted.

6. The roof antenna apparatus according to claim 5, wherein each of the first fusion hole and the second fusion hole includes a first fixing groove and a second fixing groove each having a diameter greater than diameters of the first fusion hole and the second fusion hole so that the first fusion boss and the second fusion boss inserted into the first fusion hole and the second fusion hole are fused and fixed.

7. The roof antenna apparatus according to claim 1, wherein a circuit board is mounted on an upper portion of the lower case, and the upper case includes a first watertight partition provided so that the upper case and the lower case are water-tightly coupled to each other to block an inflow of moisture into the circuit board.

8. The roof antenna apparatus according to claim 1, wherein the lower case includes a first watertight groove to receive the first watertight partition.

9. The roof antenna apparatus according to claim 1, wherein the lower case includes a roof coupling portion provided at the lower portion of the lower case to be coupled to the roof of the vehicle.

10. The roof antenna apparatus according to claim 9, wherein the spacing member includes a first spacing portion formed along a lower circumference of the lower case and a second spacing portion formed between the first spacing portion and the roof coupling portion.

11. The roof antenna apparatus according to claim 1, wherein the rubber pad includes a protrusion rib formed to protrude from a rim portion of the rubber pad toward the lower case, fitting grooves provided at the protrusion rib to allow a rim portion of the lower case to be fitted and assembled, and split grooves provided at the protrusion rib to prevent interference with the plurality of hooks.

12. The roof antenna apparatus according to claim 9, wherein the rubber pad includes a through hole provided to allow the roof coupling portion to be coupled to the roof of the vehicle through the through hole.

13. The roof antenna apparatus according to claim 12, wherein the roof coupling portion that passes through the through hole is coupled to an antenna mounting hole provided on the roof of the vehicle.

14. The roof antenna apparatus according to claim 13, wherein the rubber pad includes a plurality of second watertight partitions formed to protrude from a rim portion of the rubber pad toward the roof of the vehicle to block inflow of moisture into the antenna mounting hole.

15. A roof antenna apparatus comprising:

an upper case provided to have a streamlined dome shape and opened at a lower portion thereof;

a lower case coupled to the lower portion of the upper case to shield the opened lower portion of the upper case and configured to be coupled to a roof of a vehicle; and a rubber pad mounted to a lower portion of the lower case and including a plurality of watertight partitions provided so that the lower case is configured to be watertightly coupled to the roof of the vehicle, wherein a watertight partition positioned at an outermost side among the plurality of watertight partitions is positioned inside the upper case to be prevented from being exposed to an outside thereof, wherein the lower case includes a spacing member provided to be spaced from the rubber pad to form an air layer between the lower case and the rubber pad mounted to the lower portion of the lower case.

16. The roof antenna apparatus according to claim 15, wherein the upper case includes a plurality of fusion bosses and a plurality of hooks, and wherein the lower case includes a plurality of fusion holes into which the plurality of fusion bosses is inserted and fused and a plurality of hook coupling portions to which the plurality of hooks is coupled.

17. The roof antenna apparatus according to claim 16, wherein the plurality of fusion bosses includes a cross-shaped protrusion to determine a position where the upper case and the lower case are to be coupled, and wherein the plurality of fusion holes includes a cross-shaped groove into which the cross-shaped protrusion is inserted.

18. The roof antenna apparatus according to claim 16, wherein the rubber pad includes a protrusion rib formed to protrude from a rim portion of the rubber pad toward the lower case, fitting grooves provided at the protrusion rib to allow a rim portion of the lower case to be fitted and assembled, and split grooves provided at the protrusion rib to prevent interference with the plurality of hooks.

* * * * *